US007351005B2

(12) United States Patent
Potts

(10) Patent No.: US 7,351,005 B2
(45) Date of Patent: Apr. 1, 2008

(54) LEACHING SYSTEM

(76) Inventor: David A Potts, 385 Roast Meat Hill Rd., Killingworth, CT (US) 06419

( * ) Notice: Subject to any disclaimer, the term of this patent is extended or adjusted under 35 U.S.C. 154(b) by 103 days.

(21) Appl. No.: 11/353,016

(22) Filed: Feb. 14, 2006

(65) Prior Publication Data

US 2006/0182497 A1 Aug. 17, 2006

Related U.S. Application Data

(60) Provisional application No. 60/652,571, filed on Feb. 14, 2005.

(51) Int. Cl.
*E02B 13/00* (2006.01)

(52) U.S. Cl. ..... 405/45; 405/43; 405/44; 405/46; 405/49

(58) Field of Classification Search ..... 405/43–49
See application file for complete search history.

(56) References Cited

U.S. PATENT DOCUMENTS

| | | | | |
|---|---|---|---|---|
| 980,442 | A * | 1/1911 | Schlafly | 405/48 |
| 3,830,373 | A * | 8/1974 | Sixt | 210/489 |
| 4,182,580 | A * | 1/1980 | Hieda et al. | 405/43 |
| 4,523,613 | A * | 6/1985 | Fouss et al. | 138/121 |
| 4,759,661 | A * | 7/1988 | Nichols et al. | 405/48 |
| 5,498,104 | A * | 3/1996 | Gray | 405/43 |
| 5,511,903 | A * | 4/1996 | Nichols et al. | 405/43 |
| 5,556,231 | A * | 9/1996 | Sidaway et al. | 405/48 |
| 5,669,733 | A * | 9/1997 | Daly et al. | 405/48 |
| 6,461,078 | B1 * | 10/2002 | Presby | 405/49 |
| 6,612,777 | B2 * | 9/2003 | Maestro | 405/49 |
| 6,679,653 | B1 * | 1/2004 | DiTullio | 405/49 |
| 6,698,975 | B1 * | 3/2004 | Benecke | 405/43 |
| 2005/0074287 | A1 * | 4/2005 | Brochu et al. | 405/43 |

* cited by examiner

*Primary Examiner*—Frederick L. Lagman
(74) *Attorney, Agent, or Firm*—Pillsbury Winthrop Shaw Pittman LLP

(57) ABSTRACT

A leaching device having slots to frictionally engage soil to permit the introduction of water through the slots and into the soil while prohibiting the excessive passage of soil particles through the slots. A method of introducing water into soil by passing water through slots that frictionally engage soil to permit water to pass through the slots and which prohibits the excessive passing of soil particles through the slots.

12 Claims, 8 Drawing Sheets

LEACHING SYSTEM

CROSS-REFERENCE TO RELATED APPLICATIONS

This application claims priority to U.S. Provisional Application Ser. No. 60/652,571, filed Feb. 14, 2005, the entire contents of which are hereby incorporated herein by reference thereto.

BACKGROUND OF THE INVENTION

1. Field of the Invention

The present invention relates to the introduction of water into soil.

2. Description of Related Art

The long-term acceptance and infiltration of water into soil, earthen materials and other permeable media used for treatment (referred to collectively herein as soil) is a main component of all leaching systems. Leaching systems are utilized for general drainage applications such as with storm water (including irrigation drainage) treatment and disposal, and wastewater treatment and disposal systems. We collectively refer to all of these types of water sources as water. By the term leaching structure, we mean any device or combination of materials and devices that serve to facilitate the introduction of water into soil.

More commonly utilized leaching systems include a trench filled with gravel, a perforated pipe in the center, and filter fabric. We also refer to these components and combinations as leaching systems. Specific examples include the BioDiffuser Standard and High Capacity Chambers, manufactured by Advanced Drainage Systems/PSA, Hilliard, Ohio and Draincore 2, manufactured by Invisible Structures, Inc., Golden, Colo. Over time, the performance of all these infiltration systems generally diminishes.

This is especially problematic in situations where water, nutrients and organic matter are present; this often occurs in landscaped areas where plant fertilizers are utilized and in wastewater applications. This can occur even with parking lot drainage and others situations where organic compounds such as hydrocarbons are present. Under these conditions, the nutrients and organic matter dissolved and suspended in the water must flow through the soil/media infiltrative surface. The suspended organic matter is deposited on this interface and microorganisms flourish under these optimal conditions. This is often referred to as biomat. Over time the organic matter and microorganisms begin to diminish the hydraulic capacity and treatment efficiency of the constituents in the water.

In order to prevent premature leaching system failure, the maximum infiltration surface area is desirable. This has resulted in prior art leaching systems having relatively large penetrations through the sidewall. These penetrations are commonly about 0.25-0.50 inches high by approximately 1-4 inches long. These penetrations are typically larger on the soil interface side than they are on the inside of the leaching structure. The penetrations are intended to prevent the surrounding soil from intruding by having a so called "louver", "eyebrow" or sloped shield above them, that is aimed at preventing soil from migrating and intruding into the void of the leaching system. One commercial product with this type of penetration is the Standard EnviroChamber manufactured by Hancor, Findlay, Ohio; another is the Standard Infiltrator Chamber, manufactured by Infiltrator Systems, Old Saybrook, Conn. and which is disclosed in U.S. Pat. No. 5,511,903, which is incorporated herein by reference thereto. Reportedly, the theory behind this sloped shield was that it served to negate the angle of repose of the surrounding soil, thus theoretically preventing the soil from intruding all the way into the interior of the structure. However, this theory only serves to work when the soil is cohesive and/or when dry and gravity is the predominant force. Unfortunately, the soil is frequently damp to saturated, since the intended use is to infiltrate water. This results in reduced friction between soil particles and a change in the angle of repose. Furthermore, when the soil pores are saturated, changes in water level within the leaching structure associated with use are directly transmitted through the saturated soil pores. Under these conditions, surface tension between the water in the soil pores and the soil particles can result in fluidization and flow of soil into the leaching system. This problem is exacerbated because the cross sectional area of the typical prior art sidewall perforations are typically larger on the leaching structure/soil interface side than on the interior of the leaching structure. This results in an increase in velocity as the soil moves into the structure. When the soil intrudes into the hollow leaching system, if unchecked and not designed accordingly, it can gradually fill the entire structure. When this occurs, the performance of the leaching system can be dramatically diminished, if not eliminated.

The prevention of soil intrusion into leaching systems has been addressed through the use of geotextile filter fabrics, such as #65304 geotextile fabric manufactured by Mirafi, Pendergrass, Ga. When placed in a manner such that water flows through this material, this often results in the fabric prematurely loosing hydraulic capacity. This is commonly caused by accumulations of organic matter and the subsequent microbial fouling of the filter fabric at the infiltrative surface interface. This becomes especially problematic when the fabric is placed between the leaching structure and the high permeability soil that is typically utilized or naturally occurring around leaching systems. In this situation the capillary forces present within the fabric are significantly greater than that which is present in the surrounding soil. This results in the retention of moisture in the fabric, and optimum conditions for proliferation by microorganisms. These microorganisms tend to produce slimy substances, such as polysaccharides, that further degrade the hydraulic conductivity of the filter fabric. This is especially problematic under anaerobic conditions.

Simple round or oblong holes (holes) and perforations have also met with only limited success. If the holes are too big they will affect the structural integrity of the leaching system and soil will likely intrude the structure. If they are too small, they will clog with organic matter in the water and be particularly susceptible to biological fouling. This is especially problematic when the surface tension present between the orifice and the soil is insufficient to draw the water from the orifice in the absence of head or tension. Often times leaching structures with holes are covered with gravel or filter fabric; but as discussed above, gravel is inconvenient and expensive and filter fabric can be problematic. An example of a prior art leaching structure is the Contactor 100 Chamber manufactured by Cultec, Brookfield, Conn. This product is typically used in conjunction with gravel or filter fabric and has oblong perforations in the sidewall.

SUMMARY OF THE ASPECTS OF THE INVENTION

An aspect of the invention is a leaching chamber, including: a first side having a first base to contact a support surface; a second side having a second base to contact the support surface, the first and second bases lying in a plane; and a middle section extending between the first and second sides, each of the first and second sides having slots to permit fluid to pass through the first and second sides, each of the slots having a slot height, and the leaching chamber having a leaching chamber height extending from the plane to the middle section, the ratio of the slot height to the leaching chamber height being approximately 0.01-to-12 to 0.17-to-12.

Another aspect of the invention is a leaching chamber, including: a first side; a second side; and a middle section extending between the first and second sides, each of the first and second sides having slots to permit fluid to pass through the first and second sides, each of the slots having a slot height, and the middle section having a top portion and an opening extending through the top portion to permit fluid to pass through the middle section.

Another aspect of the invention is a leaching chamber, including: a first side; a second side; and a middle section extending between the first and second sides, the first and second sides and the middle section defining an interior chamber space, each of the first and second sides including means for frictionally engaging soil particles to resist the passing of soil from outside the chamber to the interior chamber space while permitting fluid to pass from the interior chamber space to outside the chamber.

Another aspect of the invention is a method of forming a leaching chamber, including: determining the type of surrounding soil at a intended location for installing the leaching chamber in the soil; and determining the height of slots to be made in first and second sides of the leaching chamber based on the type of surrounding soil at the intended location for installing the leaching chamber and the type of material for manufacturing the leaching chamber.

Another aspect of the invention is a method of forming a leaching chamber, including: forming a side of a leaching chamber with slots; and sizing the height of the slots such that each slot physically engages and prevents a preponderance of soil particles in the vicinity of the leaching chamber from passing through the slots from outside the leaching chamber to inside the leaching chamber such that fine soil particles that are smaller than the slots may pass through the slots, while fine soil particles that are smaller than the slots acting together may bridge a slot and block additional fine soil particles from entering the leaching chamber through the slots, and while more coarse soil particles that are larger than the slots are prohibited from entering the slot to further block additional fine soil particles from entering the leaching chamber through the slots.

Another aspect of the invention is a leaching chamber, including: a first side; a second side; and a middle section extending between the first and second sides, each of the first and second sides having slots to permit fluid to pass through the first and second sides, each of the slots having a slot height, and each of the first side, the second side, and the middle portion have an outer surface and an inner surface, the outer surface of the first and second sides and the middle portion forming a substantially continuously smooth exterior leaching chamber surface, each of the slots extending between one of the first and second side inner surfaces and the exterior leaching chamber surface.

Another aspect of the invention is a leaching chamber, including: a first side; a second side; and a middle section extending between the first and second sides, each of the first and second sides having slots to permit fluid to pass through the first and second sides, each of the slots having a slot height, and each of the first side, the second side, and the middle portion have an outer surface and an inner surface, the outer surface of the first and second sides and the middle portion forming a substantially continuously arcuate exterior leaching chamber surface, each of the slots extending between one of the first and second side inner surfaces and the exterior leaching chamber surface.

Another aspect of the invention is a leaching chamber, including: a first side; a second side; and a middle section extending between the first and second sides, each of the first side and the second side having slots to permit fluid to pass through the first and second sides, each of the slots having a height and a length, the height of each the slots being approximately 0.01-0.17 inches, each of the slots flaring toward the interior of the leaching chamber, and each of the slots having an axis that slants downwardly from the interior of the leaching chamber to the exterior of the leaching chamber.

Another aspect of the invention is a leaching chamber assembly, including; a leaching chamber having a first side, a second side, and a middle section extending between the first and second sides, the first side, the second side, and the middle section defining the interior of the leaching chamber, each of the first side and the second side having slots to permit fluid to pass through the first and second sides, each of the slots having a slot height and a length, the height of each the slots being approximately 0.01-0.17 inches; and noncohesive soil abutting an exterior surface of the first side, outside of the chamber such that the outer perimeter of each of the slots physically engages and prevents a preponderance of noncohesive soil particles in the vicinity of the first side from passing through the slots from outside the leaching chamber to the interior of the leaching chamber such that only fine noncohesive soil particles that are smaller than the slots may pass through the slots while more coarse noncohesive soil particles that are larger than the slots are prohibited from entering the slots and form a blockage prohibiting additional fine soil particles from entering the leaching chamber through the slots.

Another aspect of the invention is a method of introducing water into soil, including: positioning a leaching device adjacent soil, the leaching device including a wall with slots, each of the slots having a slot height and a slot length, the slot height of each slot being approximately 0.01-0.17 inches; and passing water through the slots and into the soil.

Another aspect of the invention is a method of introducing water into soil, including: positioning a leaching device adjacent soil, the leaching device including a wall with slots, each of the slots having a slot height and a slot length, the slot height of each slot being less than or equal to approximately 0.09 inches; and passing water through the slots and into the soil.

Another aspect of the invention is a leaching chamber assembly, including; a leaching chamber having a first side, a second side, and a middle section extending between the first and second sides, the first side, the second side, and the middle section defining the interior of the leaching chamber, each of the first side and the second side having slots to permit fluid to pass through the first and second sides, each of the slots having a slot height and a length, the height of each the slots being approximately 0.01-0.17 inches; and soil adjacent an exterior surface of the first side, outside of the chamber such that water within the interior of the leaching chamber may pass through the slots and be introduced into the adjacent soil.

Another aspect of the invention is a leaching chamber, including; a first side; a second side; and a middle section extending between the first and second sides, the first side, the second side, and the middle section defining the interior of the leaching chamber, each of the first side and the second side having slots to permit fluid to pass through the first and second sides, each of the slots having a slot height and a length, the height of each the slots being approximately 0.01-0.17 inches, and the first and second sides being coated with a biocide.

Another aspect of the invention is a leaching chamber, comprising: a first side; a second side, each of the first side and the second side having slots to permit fluid to pass through the first and second sides; a middle section extending between the first and second sides, the first side, the second side, and the middle section defining the interior of the leaching chamber; and a leaching device positioned beneath the middle section, between the first and second sides, and between the interior of the leaching chamber and the soil supporting leaching chamber, the leaching device structured and arranged to permit the passage of water from the interior of the leaching chamber to the soil while blocking soil from entering the interior of the leaching chamber.

Another aspect of the invention is to provide for the long-term introduction and treatment of water into soil, yet still be cost effective.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

BRIEF DESCRIPTION OF THE DRAWINGS

The illustrated embodiment of the present invention is further described in the detailed description which follows, by reference to the noted drawings by way of non-limiting exemplary embodiments, in which like reference numerals represent similar parts throughout the several views of the drawings, and wherein.

DETAILED DESCRIPTION OF THE INVENTION

Figure 2:
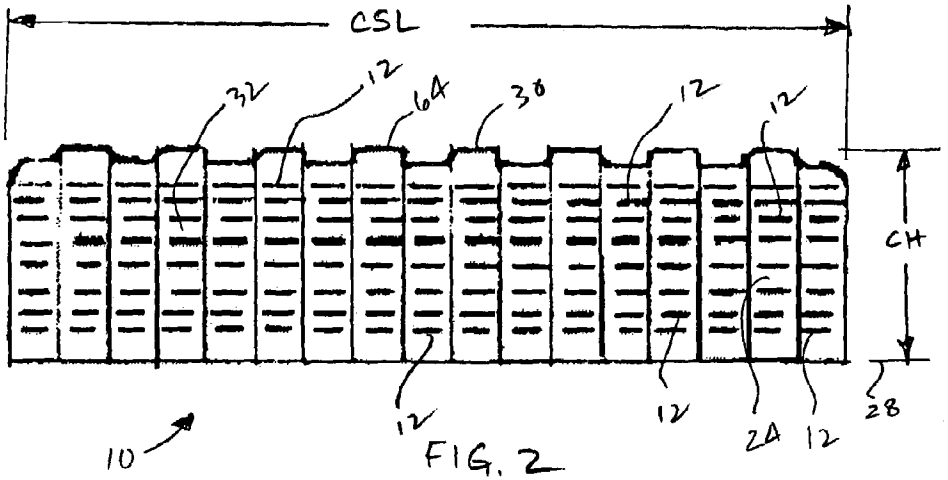
FIG. 2 shows a side elevational view of the leaching chamber of FIG. 1.
Figure 1:
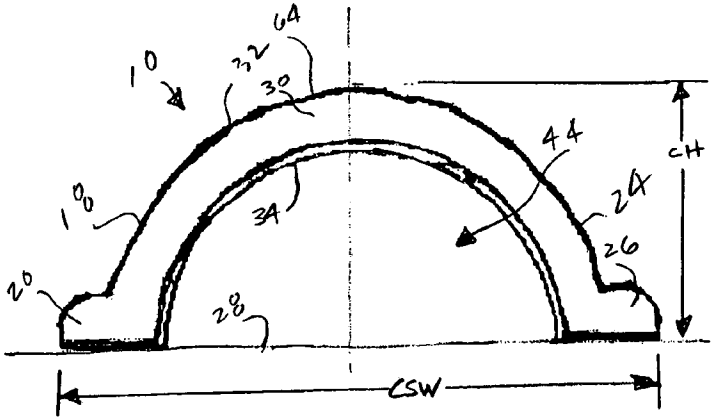
FIG. 1 shows a front of a leaching chamber in accordance with one embodiment of the subject invention.
Figure 8:
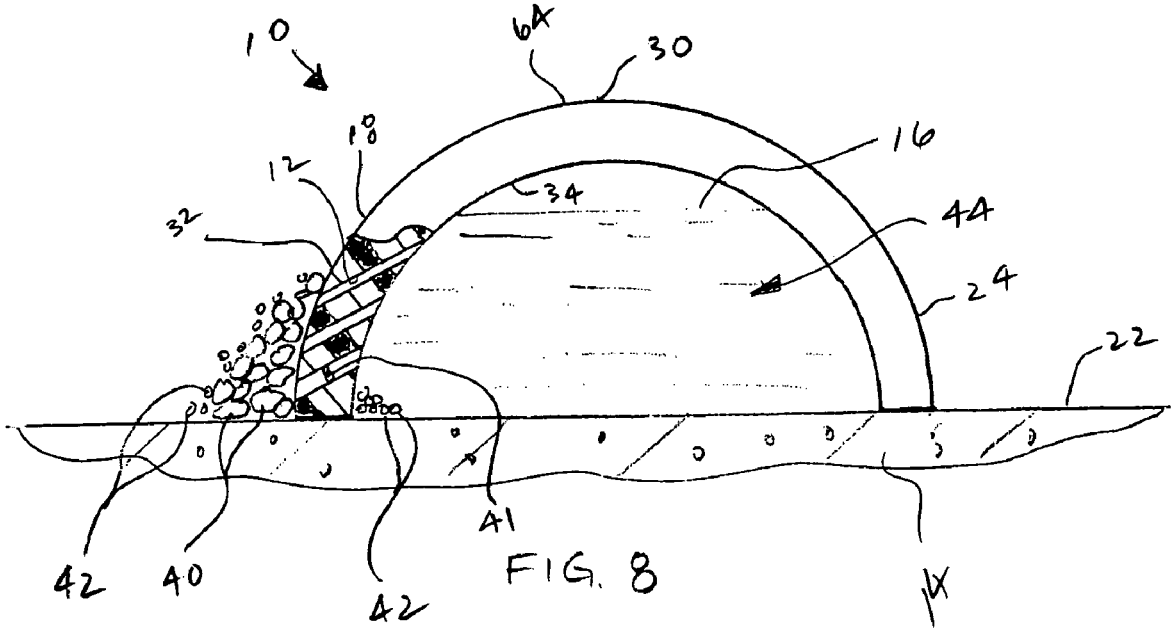
FIG. 8 shows a partial cross-sectional front elevational view of a leaching chamber in accordance with another embodiment of the invention.

One embodiment of the subject invention is illustrated in FIGS. 1-2, which show a leaching device in the form of leaching chamber 10 having slots 12 to frictionally engage soil 14 (as best seen in FIG. 8) to permit the introduction of water 16 through the slots 12 and into the soil 14 while prohibiting the excessive passage of soil 14 particles through the slots 12. The leaching chamber 10 of FIGS. 1-2 includes a first side 18 having a first base 20 to contact a support surface 22, which is typically soil 14. The chamber 10 includes a second side 24 having a second base 26 to contact the support surface 22. The first and second bases 20 and 26 may lie in a plane 28. The chamber 10 also has a middle section 30 extending between the first and second sides 18 and 24. Each of the first and second sides 18 and 24 have slots 12 to permit fluid, such as water 16 to pass through the first and second sides 18 and 24.

Each of the slots 12 has a slot height "h," and a slot length "l." The leaching chamber 10 has a leaching chamber height "CH" extending from the plane 28 to the middle section 30. Each chamber has a chamber section length "CSL" extending from one end of the chamber to the other parallel to the longitudinal axis of the chamber 10. In typical use, numerous chambers 10 would be connected together and strung along a desired length to form a run of chambers extending over a leaching field. As seen in FIGS. 1 and 3, the first and second sides 18, 24 and the middle section 30 form an arcuate cross-section. Further, each of the first side 18, the second side 24, and the middle portion 30 form a chamber outer surface 32 and a chamber inner surface 34. The outer surface 32 of the first and second sides 18 and 24 and the middle section 30 may form a substantially continuously smooth and arcuate chamber outer surface 32, as illustrated, with each of the slots 12 extending between the inner chamber surfaces 34 and the outer chamber surface 32.

The geometry and orientation of the slots 12 in the leaching structure, such as leaching chamber 10, is significant. The preferred penetration design is in part dependent on the material from which the leaching system is manufactured. The leaching device may be made of a variety of materials. One material that has typically performed well is high density polyethylene (HDPE). HDPE is largely inert and it can be manufactured into a variety of leaching structures, components and systems.

As mentioned above, the sidewalls 18 and 24 are slotted to function more effectively for use buried directly in soil 14 and with the water infiltration applications described herein. HDPE is fairly dense and slippery; consequently it has a relatively low surface tension/capillary effect on water. Penetrations in the leaching device in accordance with the present application may be formed in the shape of a relatively narrow slot 12. This slot 12 may have various shapes and configurations. In one embodiment, slot length l is intended to be not less than 0.25 inches in length, and assuming no structural limitations in the construction material, may be as long as desired, while the slot height h may range from 0.01-0.17 inches. Slot heights h in the lower end of this range may be most effective in finer grained soils and sands with a high uniformity coefficient. In finer grained sands, an air injection system such as that disclosed in U.S. Pat. No. 6,485,647 can also be beneficial. U.S. Pat. No. 6,485,647 is hereby incorporated herein by reference thereto. The height of the slot h and the slot spacing "s" (which is the spacing between adjacent slots 12) are, in part, dependent on the material in which the slots 12 are manufactured and the characteristics of the surrounding soil 14, including the capillarity of the soil.

In one embodiment illustrated in FIG. 8, the slots 12 may be sized to physically engage and prevent the preponderance of soil particles 40 in the vicinity of the leaching structure 10 from passing through the slots 12. When the slot 12 is sized accordingly, some finer soil particles 42 that are directly adjacent to the slot 12 may migrate into the slot 12 or further into structure 10. The system may be designed to permit a particular amount of finer soil particles within a leaching structure while not permitting an amount of soil into the structure that would close off necessary open space needed for the desired transport of water or an amount that would remove soil from areas surrounding and on top of the structure such that the ground above the buried structure would show a depression at the ground surface. This process is referred to as the development of the sidewall interval. The slot 12 and the leaching structure void space (e.g., the interior 44 of the chamber 10) can be designed to accommodate these transported finer grained soil particles 42. Left behind, now directly adjacent to the open interval of the slot 12, the coarser soil particles 40 now effectively serve to retain the finer soil particles 42 behind them. Further, the slot 12 may be designed so that a soil particle 42 that itself may be sufficiently small to pass through the slot 12, but together with other finer particles 42 will become stuck within the slot 12 as the particles 42 form a bridge 41 between the slot walls and prohibit each other from passing through the slot 12. Thus, the particles create a bridge 41 across the walls of the slot 12 and prevent additional small particles 42 from passing through the slot 12 while permitting water to pass through the slot 12 for introduction into the soil.

A slot size for use in general soil conditions and applications may be approximately 0.04-0.12 inches high and 1.0-2.0 inches long, as measured at the soil leaching structure interface (e.g., the outside surface 32, or soil engaging surface, of the chamber 10). Although various slot heights h and lengths l may be employed with various sized leaching devices, one embodiment includes having a range for the slot height h being approximately 0.01-0.17 inches while the leaching chamber height CH is approximately 12 inches or higher. Thus, one ratio of the slot height h to the leaching chamber height CH may be approximately 0.01-to-12 to 0.17-to-12. The slot sizing mentioned above is intended to be used with all typically-sized leaching chambers. Such typical leaching chambers are approximately 12 to 16 inches or higher. The chamber section length CSL may vary depending upon the length desired for the chamber. The chamber section length CSL may be approximately the length of typical leaching chambers, that is, 60 inches or 48 inches. The chamber section width CSW may also vary depending upon the length sizing for the chamber. The chamber section length CSW may be approximately the width of typical leaching chambers, such as, 16 inches, 22 inches, 30 inches, or 34 inches.

Figure 3A:
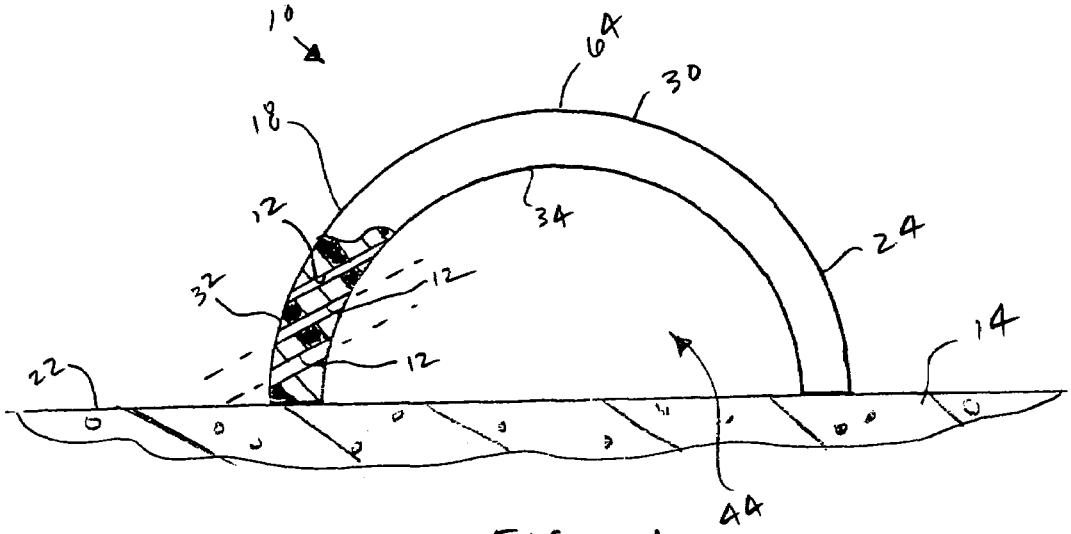
FIG. 3*a* shows a partial cross-sectional front elevational view of the chamber of FIG. 1.
Figure 3B:
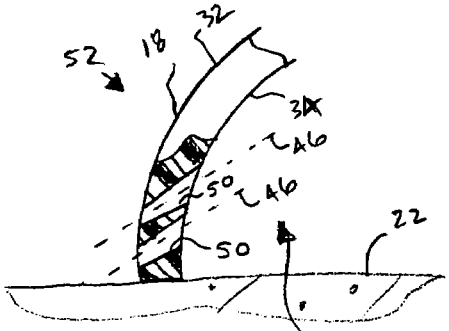
FIG. 3*b* shows a partial cross-sectional front elevational view of the chamber of FIG. 1 with another embodiment of the slot configuration.
Figure 4:
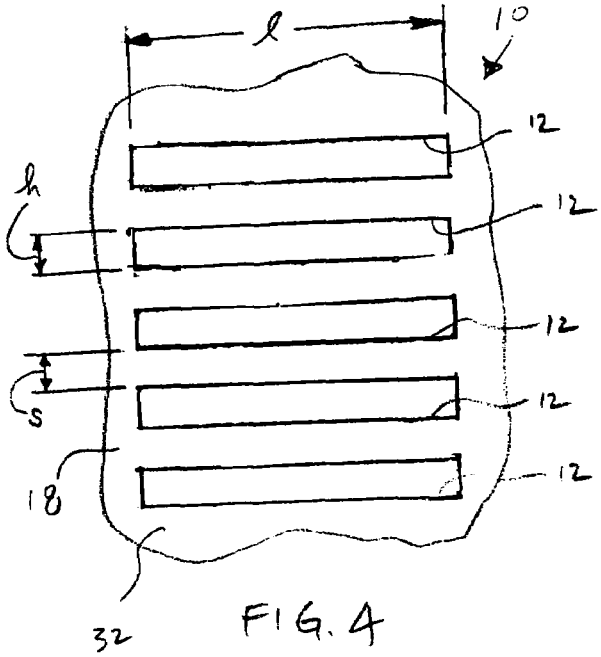
FIG. 4 shows an enlarged, partial side elevational view of the chamber of FIG. 1.
Figure 5:
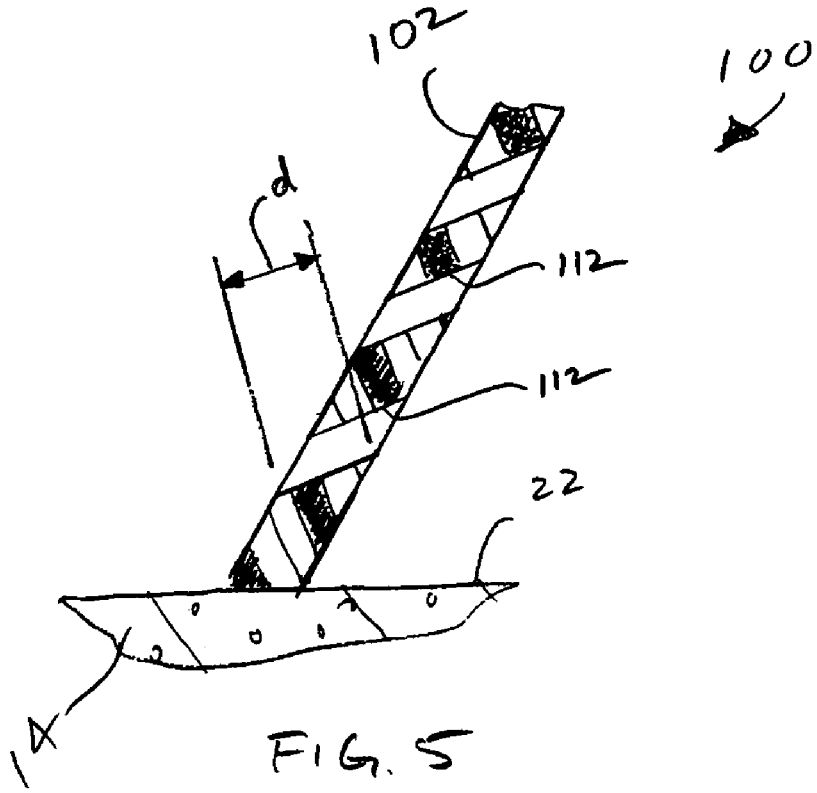
FIG. 5 shows a partial cross-sectional front elevational view of a leaching chamber similar to FIG. 3 but showing another embodiment of the invention with a substantially planar wall.
Figure 6:
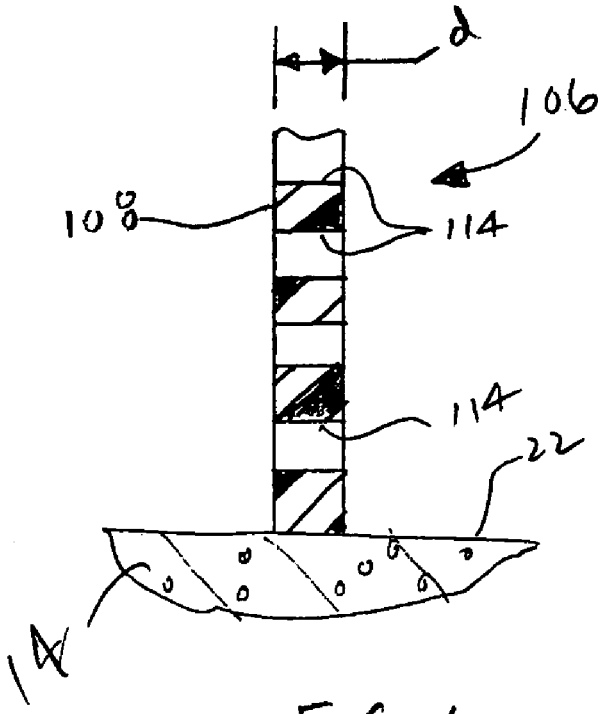
FIG. 6 shows a partial cross-sectional front elevational view of a leaching chamber similar to FIG. 3 but showing yet another embodiment of the invention with a substantially vertical wall.

As seen in FIGS. 3*a* and 3*b*, the slots 12 may be angled downwardly in that the axis 46 of each slot is angled downwardly from the interior 44 of the chamber toward the outside of the chamber. Additionally, as seen in FIG. 3*b*, the slots may be tapered slots 50 as in chamber 52 so that they flare inwardly toward the interior 44 of the chamber 52. Chamber 52 may be otherwise substantially identical to chamber 10. The slots may also be tapered in the opposite direction toward the outside of the chamber. The slot 12 may be oriented at a downward angle when in a curved (FIGS. 3*a* and 3*b*) and/or largely vertically oriented sidewall of a leaching structure. This slot configuration further serves to improve performance by taking advantage of the force of gravity on the soil grains. A vertically oriented sidewall leaching structure is known such as the Contactor 100, 125 and EZ-24 Chambers, manufactured by Cultec, Brookfield, Conn. Also, when the leaching structure is not slotted at a 90 degree angle to the penetrated surface 32, the resultant slot depth d is larger, such as seen in FIGS. 5 and 6, wherein the slot depth d for the slots 112 in FIG. 5 are deeper than the slots 114 in FIG. 6. This resulting increase in the relative thickness of the slot also serves to increase the soil particle contact area and travel distance. This in turn increases the total frictional resistance against which the force transporting the soil particles 42 must overcome in order for soil to ultimately move into the leaching structure void 44.

Figure 9:
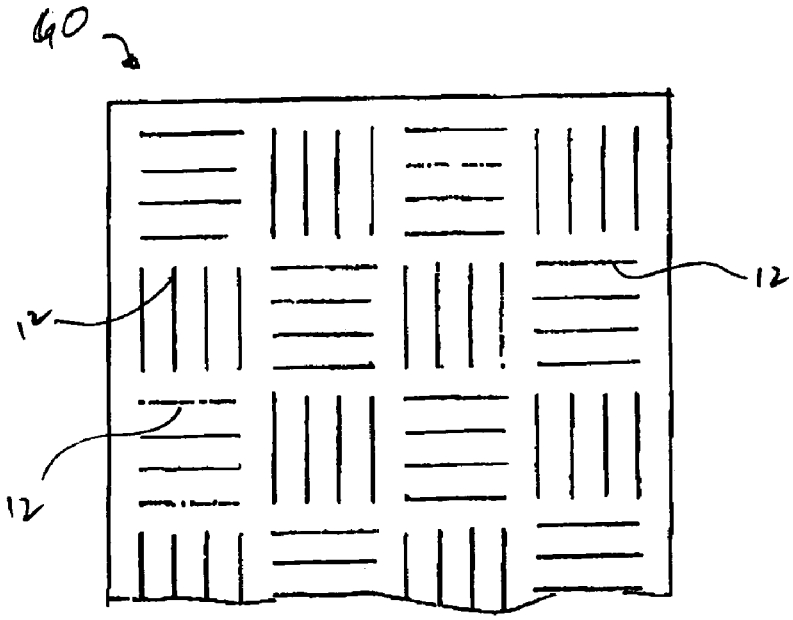
FIG. 9 shows a leaching device in accordance with another embodiment of the invention.
Figure 10:
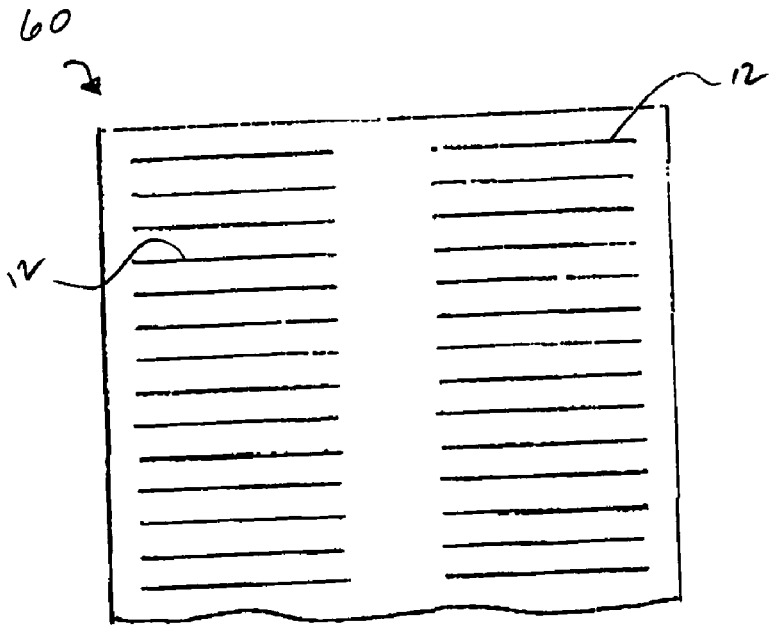
FIG. 10 shows another leaching device in accordance with another embodiment of the invention.
Figure 11:
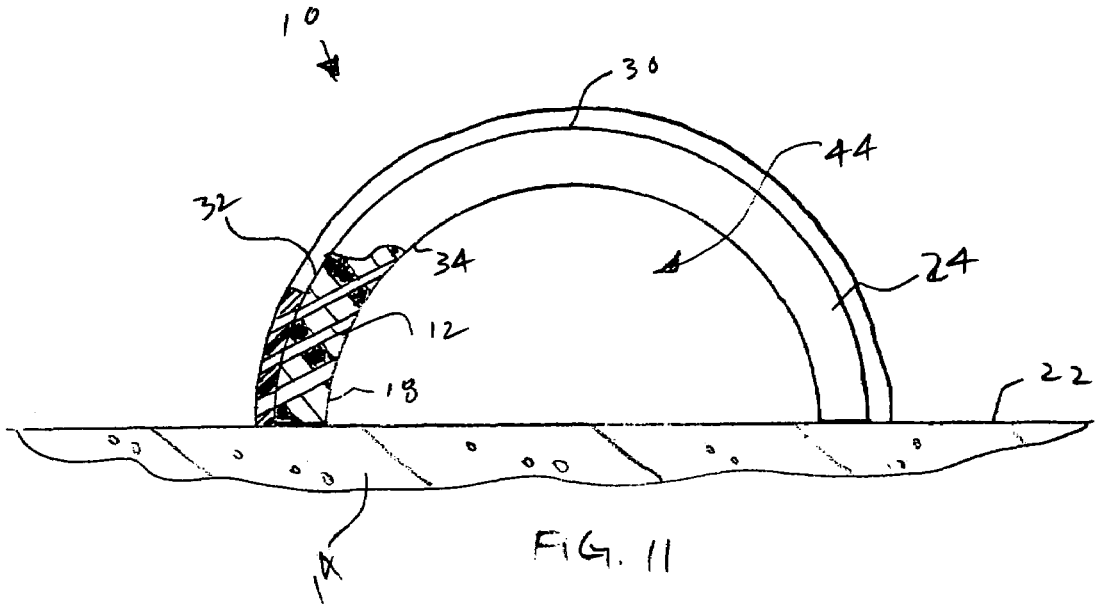
FIG. 11 shows a partial cross-sectional front elevational view of a leaching chamber in accordance with another embodiment of the invention.

In another embodiment, as seen in FIGS. 9 and 10, thin, flexible filtering-type materials such as GSE HD, manufactured by Gundle/SLT Environmental, Inc. can be formed into sheets 60 and provided with slots 12 with a similar configuration and geometry as described above. This sheet 60 may be placed over a leaching device such as chamber 10 as seen in FIG. 11, or over a gravel base and may also be installed between layers of different treatment media. As seen in FIG. 9, the slots 12 may be oriented orthogonally with respect to each other, or as seen in FIG. 10, may be substantially parallel to each other.

As an alternative method to manufacturing the slotted sidewall directly into typical plastic leaching structures such as chamber 10, the slots 12 may be employed in concrete galleries, pipe, and other comparable structures. Also, these structures may be covered with slotted sheets 60. In these applications, concrete structures and the like may also be installed with or without gravel adjacent to the sidewalls 18, 24.

Although FIG. 3B shows slots 50 in the sides 18 flaring inwardly toward the interior 34 of the chamber 52, in all the embodiments herein, the slots may be tapered to be wider or narrower on the inside, outside, top or bottom of the leaching structure. This serves to further physically engage additional soil particles, or to facilitate construction of the slot. This taper could also take on other shapes such as the shape of a radius left over from slotting with, for example, a round circular saw blade. In many soil types it is desirable to have the slot smaller at the leaching structure/soil interface, i.e., the outer surface 32 of the leaching structure, than it is inside the leaching structure. This often serves to best prevent soil movement into the structure.

Although the leaching chamber 10 is shown as having an arch-shaped cross-section, the embodiments of the invention may be employed with various type and shapes of chambers in addition to generally arch-shaped chambers. For example, FIG. 5 shows a chamber 100 with side walls 102 that are substantially straight, or flat but at an incline with respect to the support surface 22. Also, FIG. 6 shows a chamber 106 with substantially straight or flat side walls 108 that are substantially perpendicular to support surface 22. The slots 112 and 114 extending through walls 102 and 108, respectively, may be substantially similar to slots 12 discussed herein and the other aspects of the chambers 100 and 106 may be substantially similar to those of chamber 10 discussed herein.

In certain instances it is desirable to place select fill, soil or other specific media (collectively referred to as media) adjacent to the slots as seen, for example, in FIG. 8 wherein soil 14 is shown adjacent the chamber 10. The specific media and the dimensions and configuration of the slots 12 can be engineered to retain and pass a certain percentage or size range of media. The media that passes into the leaching structure and the media that remains outside the leaching structure can be designed to provide for additional water treatment. This is especially helpful in poor soils or where additional treatment is required by a regulatory agency. The leaching structure, such as chamber 10, may also be filled with media to varying levels. For example, media may be inserted into the interior 44 of chamber 10. Media can move around freely in the leaching structure, lay static at the bottom or supporting surface 22, or be retained in bags or other devices. A leaching chamber may also be formed with hollow side walls 18 and 24, which still contain slots 12, and a hollow middle section 30, and those hollow walls and sections may be filled with media. The media can also be retained in devices outside the leaching structure adjacent to the sidewall.

Almost any engineering material can be slotted in the manner described herein, including metal, concrete and thermoplastics. They may be machined, injection or vacuum molded, or thermoformed from plastic sheet stock as well as many other commercial manufacturing techniques. Materials such as a fluorocarbon polymer (e.g., Teflon) may also be used and are more difficult for microorganisms to establish communities thereon due to its composition and structure. As mentioned above, HDPE may also be used. The material forming the leaching device and from which the slotting is ultimately manufactured may also be topically coated with desirable agents or have the agents homogenized into the thermoplastic resin melt prior to extrusion or injection molding. These materials can also be amended with biocides and antimicrobial agents. An example of a product like this is AgION, AgION Technologies, Wakefield, Mass. Materials such as biocides may be used as a coating for a leaching device such as chamber 10 to destroy living organisms on the chamber 10, including but not limited to roots and microorganisms.

Leaching structures such as the StormTech SC-310 comprise a generally constant curve cross sectional arch-shaped geometry and corrugations to provide for specific structural characteristics. This allows these leaching structures to be manufactured with a comparatively thin wall structure, resulting in an efficient strength-to-weight ratio. The slotted sidewall in accord with this invention may be employed with such a leaching structure to provide improved slotting in combination with a thin, strong structural shape, which equates to a cost savings with respect to the required volume of thermoplastic resin necessary to produce the leaching structure as well as a reduction in shipping costs. This also results in a lighter product to handle and install.

The leaching devices in accordance with the embodiments of the invention may be constructed with relatively thin side walls (18, 24) and without louvers, which are known in the prior art as a form of protective roof over an opening as discussed above. Therefore, the leaching devices of the subject application may be made without utilizing significantly more thermoplastic resin in the process, assuming similar structural efficiencies are to be maintained.

Significant differences in oxygen levels have been observed in leaching structures surrounded by gravel verses plastic leaching structures, such as the Infiltrator Standard Chamber when buried directly in soil. In general, the systems surrounded in gravel have significantly more oxygen present within the void space 44 than do the sealed top plastic leaching structures buried directly in soil. This determination is based on both field measurements and more controlled tests. This may likely affect the lifespan of the various leaching systems. Consequently, in another embodiment of the subject invention, the top 64 of the leaching structure, such as chamber 10, is perforated or slotted to enhance oxygen transfer into the leaching structure from atmosphere. This oxygen serves to increase the overall microbial metabolic rate of the microorganisms present within and adjacent to the leaching structure. This further results in an increase in the overall population of the microbial community, which responds by digesting the organic matter that is deposited on the soil/leaching structure interface. In turn, a high level of infiltration is maintained over a longer period of time. The increased oxygen concentration in the leaching structure also serves to improve the removal efficiencies of the water constituents and pathogens prior to discharge to groundwater or surface water bodies.

Figure 7:
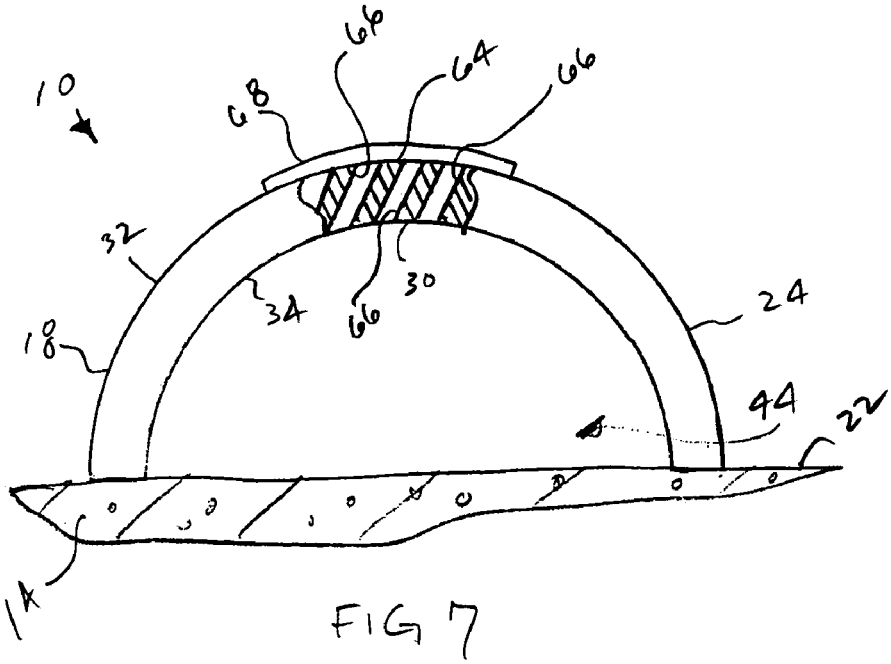
FIG. 7 shows a partial cross-sectional front elevational view of a leaching chamber in accordance with another embodiment of the invention.

In the simplest form, perforations are made in the top 64 of the leaching structure. As illustrated in FIG. 7, the middle section 30 has a top portion 64 and an opening 66 extending through the top portion 64 to permit fluid, such as oxygen, to pass through the middle section 30. The opening 66 may take many forms and may be an opening of various shapes, sizes, configurations, and numbers. The opening 66 in FIG. 7 is illustrated as multiple apertures that are formed as slots that are substantially identical to slots 12 on the side walls and may alternatively take the form of any of the slots described herein with respect the various embodiments.

The openings in the top portion 64 may be covered with a geotextile fabric 68 as see in FIG. 7 to prevent soil intrusion and/or water intrusion while permitting gases, such as oxygen to enter the interior 44 of the chamber. The slotting techniques described in this application could also be utilized in the fabric such as discussed with respect to FIGS. 9 and 10. Also, fabric not requiring slotting may be employed such as those that permit the passing through of gas while shedding water, such as breathable, water-repellent fabric laminates, e.g., Tyvek or Gortex.

Another embodiment of the invention extends the slotting interval as far as possible up the sidewalls 18, 24 of the leaching structure, to a point proximate to the top 64 of the structure, such as chamber 10. Alternatively, the entire leaching structure may be slotted. Thus, the entire sidewalls 18 and 24 and middle section 30 may be slotted in chamber 10. Prior art sidewall louvers as mentioned above may be omitted from any slots anywhere on the leaching devices. The mentioned embodiments enable oxygen to pass through the leaching structure into the soil with the water. This was not possible with prior art sidewall louvers that were often entirely below the ponding level of the water inside the structure.

As an additional embodiment, a thick geotextile fabric, such as Enkadrain 9120 (Colbond—USA), can overly the top of a leaching device such as chamber 10 and extend down, similar to that shown in FIG. 11, to the slots 12 to facilitate oxygen transfer to this deeper interval. The geotextile fabric may also be utilized on top 64 of the leaching structure when vent perforations 66 are present in the top 64. This thicker geotextile fabric serves to permit fewer vent holes in the top by better flowing and distributing air into the structure. Surrounding the chamber 10 with pea stone and the like may also be employed.

Figure 12:
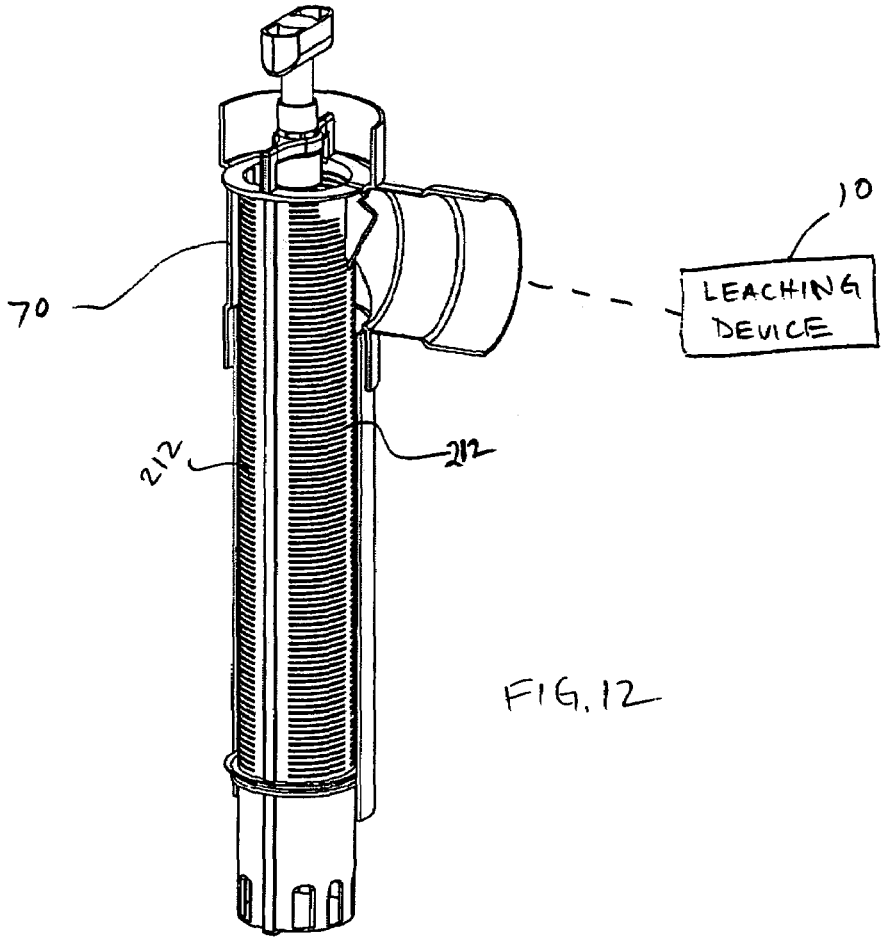
FIG. 12 shows a leaching assembly in accordance with another embodiment of the invention.
Figure 16:
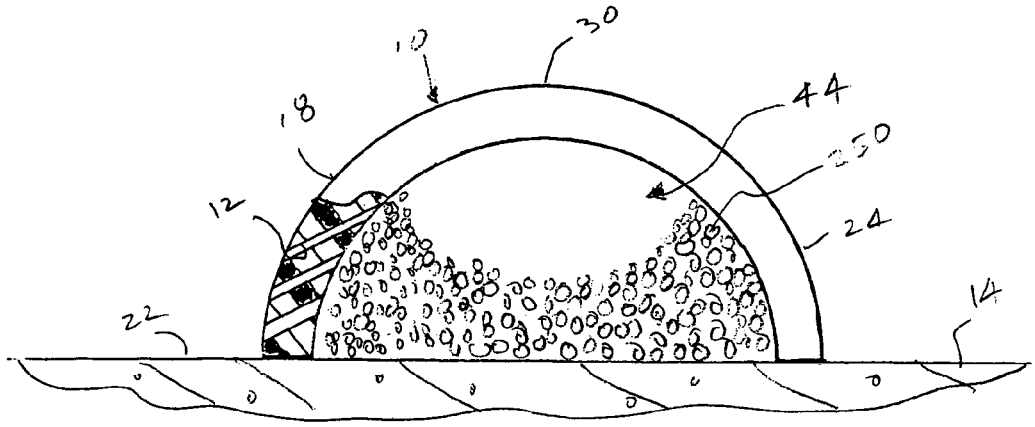
FIG. 16 shows a cross-section of a leaching chamber in accordance with another embodiment of the subject invention.
Figure 17:
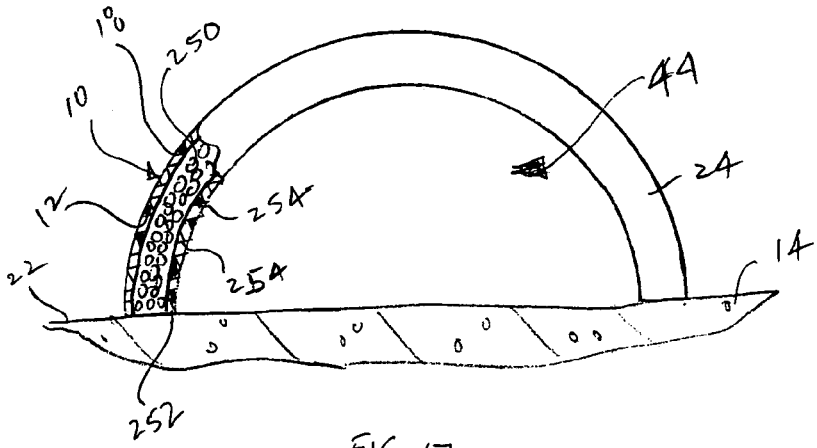
FIG. 17 shows a cross-section of a leaching chamber in accordance with another embodiment of the subject invention.

An additional embodiment of the invention includes the insertion of a filter, screen, or other filtering device or media, including granular media, that provides filtering of water upstream of the slots in the leaching device. The filtering device or media may be outside a leaching chamber, may be inside a leaching chamber, or may be both outside and inside a leaching chamber. The filtering device or media may have openings to permit water to pass through the filtering device, such filtering device openings may be approximately equal to or less than the slot height in the first and second sides 18 and 24 of chamber 10. (In the instance of a granular filtering media, the openings may be construed as the space between the grains of the granular filtering media.) For example, as seen in FIG. 12, an effluent filter 70 may be installed in a septic system upstream of a leaching chamber 10. The filter 70 may be constructed with slots 202 that are substantially the same size as or smaller than the slots 12 in the leaching chamber 12. Additionally, as seen in FIG. 16, granular filtering media 250 may be positioned against the openings of slots 12 in the interior 44 of a leaching device, such as chamber 10. Also, as seen in FIG. 17, granular filtering media 250 may be held in position against the slots 12 of a leaching device, such as chamber 10, by a backing member 252 having slots or openings 254 that may be substantially equal to or less than the openings 254 in the filtering media 250.

Figure 14:
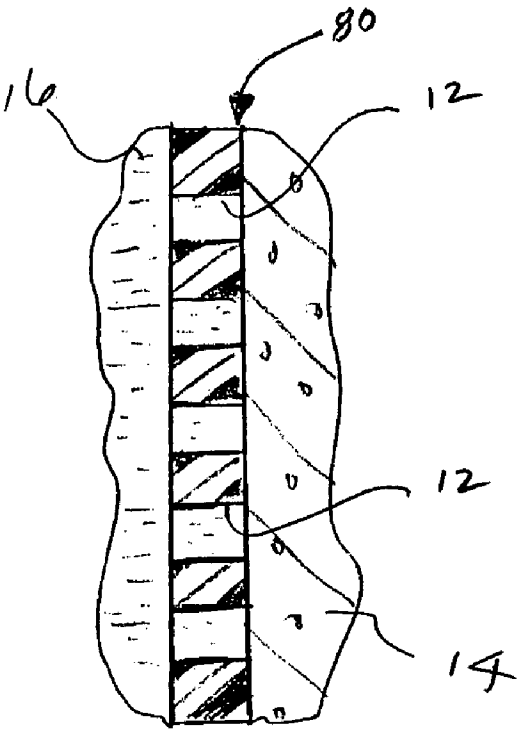
FIG. 14 shows a cross-sectional view of the leaching device taken along line 14-14 of FIG. 13.
Figure 13:
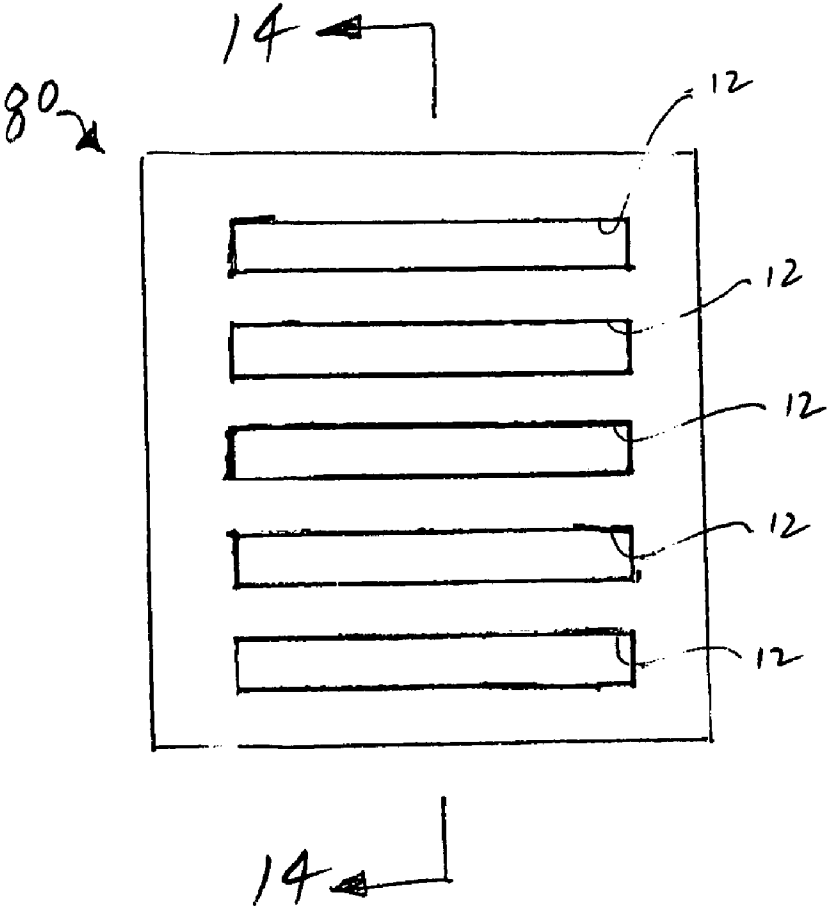
FIG. 13 shows a front view of a leaching device in accordance with another embodiment of the invention.

Although most of the illustrated embodiments have shown arch-shaped leaching chambers, it should be understood that any type and shape of leaching device may employ the principles disclosed herein, particularly with respect to the slot sizing, shaping and configuration. For example, FIGS. 13 and 14 show a leaching device in the form of a panel 80, which may be a substantially flat panel used by itself or as part of a leaching device such as a chamber. As seen in FIG. 14, the panel 80 abuts soil 14 and permits water 16 to pass through the slots 12 for introduction of the water into the soil 14.

Figure 15:
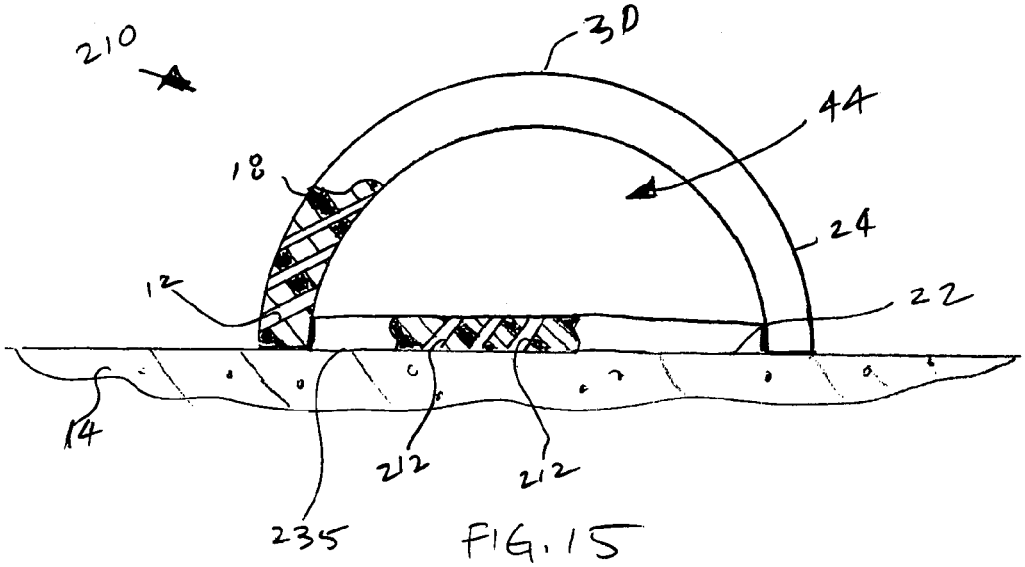
FIG. 15 shows a cross-section of a leaching chamber in accordance with another embodiment of the subject invention.

In another embodiment of leaching chamber assembly, FIG. 15 shows a leaching chamber 210 that may be substantially identical to the leaching chamber 10 illustrated in FIG. 1, but including a leaching device 235 positioned beneath the middle section 30, between the first side 18 and the second side 24, and between the interior 44 of the leaching chamber 210 and the soil 14 supporting leaching chamber 210. The leaching device 235 may be structured and arranged to permit the passage of water from the interior 44 of the leaching chamber 210 to the soil 14 while blocking soil 14 from entering the interior 44 of the leaching chamber 210. The leaching device 235 may include slots 212 that are substantially identical to slots 12 described above. The slots 212 may permit small amounts of soil 14 to enter the interior 44 of the chamber while blocking soil 14 in the same manner described with respect to slots 12. Thus, the device 235 can protect the infiltrative surface of the soil 14 beneath a leaching chamber, such as leaching chamber 10, from damage by translocation of fine soil particles, such as silt and clay. In other words, the leaching device 235 maintains the soil 14 beneath a leaching chamber in place. The leaching device 235 may be formed with the sides 18 and 24 and middle section 30 to form a unitary, one piece chamber or may be formed as a separate structure, including a structure that may be independently and separately positioned with respect to the first and second sides 18, 24. Also, the leaching device 235 may be a relatively rigid device formed of the same material as the leaching chamber 10 described above, such as plastic. The leaching device 235 may take other forms such as a flexible sheet such as described above with respect to FIGS. 9 and 10. Also, the leaching device 235 may provide a supporting surface on which a leaching chamber such as chamber 10 is placed and provide a surface that extends beyond the outside extent of the sides 18 and 24.

Other objects, features, and advantages of the illustrated embodiment of the present invention and the present invention will become apparent from the following detailed description of the illustrated embodiment of the present invention, the accompanying drawings, and the appended claims.

What is claimed is:

1. A leaching chamber, comprising:

a first side having a first base to contact a support surface;

a second side having a second base to contact the support surface, said first and second bases lying in a plane; and a middle section extending between said first and second sides, each of said first and second sides having slots to permit fluid to pass through said first and second sides, each of said slots having a slot height, and the leaching chamber having a leaching chamber height extending from said plane to said middle section, the ratio of said slot height to said leaching chamber height being approximately 0.01-to-12 to 0.17-to-12.

wherein said middle section has a top portion and an opening extends through said top portion to permit fluid to pass through said middle section.

2. A leaching chamber according to claim 1, wherein said opening includes multiple apertures.

3. A leaching chamber according to claim 2, wherein said multiple apertures are substantially similar to said slots.

4. A leaching chamber according to claim 2, wherein the multiple apertures are oriented in a non-orthogonal direction with respect to the support surface.

5. A leaching chamber, comprising:

a first side;

a second side; and a middle section extending between said first and second sides, each of said first and second sides having slots to permit fluid to pass through said first and second sides, each of said slots having a slot height, and said middle section having a top portion and an opening extending through said top portion to permit fluid to pass through said middle section, wherein said opening has a height of approximately 0.01 to 0.17 inches.

6. A leaching chamber according to claim 5, wherein said opening includes multiple apertures.

7. A leaching chamber according to claim 6, wherein said multiple apertures are substantially similar to said slots.

8. A leaching chamber according to claim 7, wherein said apertures are covered by a material structured and positioned to permit fluid to pass through said apertures but not to permit a substantial amount of soil to pass through said apertures.

9. A leaching chamber according to claim 6, wherein said apertures are covered by a material structured and positioned to permit fluid to pass through said apertures but not to permit a substantial amount of soil to pass through said apertures.

10. A leaching chamber according to claim 6, wherein the multiple apertures are oriented in a non-orthogonal direction with respect to the surface of the soil.

11. A leaching chamber according to claim 5, wherein said opening is covered by a material structured and arranged to permit air to pass through while prohibiting water from passing through.

12. A leaching chamber according to claim 5, wherein said opening is covered by a material structured and positioned to permit fluid to pass through said opening but not to permit a substantial amount of soil to pass through said opening.

* * * * *